US005669492A

United States Patent [19]

Chao

[11] Patent Number: 5,669,492

[45] Date of Patent: Sep. 23, 1997

[54] PORTABLE HANGING TYPE TOOL KIT STRUCTURE

[76] Inventor: Li Ming Chao, No. 20, F2, Lane 21, Wang-Ang Street, Taipei, Taiwan

[21] Appl. No.: 708,623

[22] Filed: Sep. 5, 1996

[51] Int. Cl.[6] ..... B65D 69/00; B25G 1/08; B26B 11/00

[52] U.S. Cl. ..... 206/234; 30/125; 30/164; 81/440; 81/177.4

[58] Field of Search ..... 206/234, 372, 206/373, 371, 214, 806; 30/125, 151, 164; 81/440, 437, 177.4, 490

[56] References Cited

U.S. PATENT DOCUMENTS

| | | | |
|---|---|---|---|
| 2,503,380 | 4/1950 | Derby | 206/234 |
| 4,384,499 | 5/1983 | Shockley | 81/177.4 |
| 4,836,066 | 6/1989 | Graham et al. | 81/177.4 |

*Primary Examiner*—Paul T. Sewell
*Assistant Examiner*—Anthony Stashick
*Attorney, Agent, or Firm*—Pro-Techtor International

[57] ABSTRACT

A portable hanging type tool kit structure including an outer box, an inner box, a transverse pin and several tools. The outer box is a hollow box body, having a rear close end formed with a rectangular opening and a front open end through which the inner box is placed into the outer box. An upper side of the outer box is disposed with a clip member for hanging the tool kit on a belt or a pocket. A lower side of the outer box is formed with a slot adjacent to the open end. A first or a second lateral side of the outer box is disposed with a hanging lug for hanging the tool kit. The inner box includes two lateral walls, a rear wall and a bottom board. The rear wall is formed with a notch in which a resilient latch block is located. The bottom board is formed with several slits at front end to divide the front end of the bottom board into several resilient plates. Two symmetrical recesses are formed on front ends of the two lateral walls. The transverse pin is horizontally fixed in the recesses. Each tool is formed with a through hole at rear end for the transverse pin to pass therethrough. When using the tool, the inner box is drawn out of the outer box and then the needed tool is rotated through 180 degrees and then the inner box is retracted into the outer box.

2 Claims, 7 Drawing Sheets

PORTABLE HANGING TYPE TOOL KIT STRUCTURE

BACKGROUND OF THE INVENTION

The present invention relates to a portable hanging type tool kit structure for receiving various tools such as screwdriver, ball pen, flashlight, knife, etc.

FIGS. 10 to 13 show several kinds of conventional tool kits for receiving tools such as screwdriver.

None of the above tool kits employs a transverse pin which is fixed in the kit and passed through the tools as a rotary shaft. Generally, in the conventional tool kit, the needed tool must be first separately taken out and then inserted into a tube or a hole for fixing the tool so as to use the tool. According to such arrangement, when the tool kit is inclined or reversely located, the tools in the tool kit often all drop out of the tool kit. Therefore, the user must be very cautious in taking and using the tool. In addition, as shown in FIGS. 11 to 13, the tool 200 is first assembled with a grip 300 before used. When a force is applied to the grip 300, one half of the diameter of the grip serves as the arm of force of the torque. Such arm of force is shorter so that greater application force is needed. Moreover, when suffering a high torque, the grip 300 is rotated through a circle so that the user's hand can hardly tightly hold the grip without slippage. In FIG. 10, the tool 200 is inserted in a tube 401 of the tool kit 400 and used according to the principle of couple. In use, the tool is apt to loosen and drop out of the tube 401.

SUMMARY OF THE INVENTION

It is therefore a primary object of the present invention to provide a portable hanging type tool kit structure including an outer box, an inner box, a transverse pin and several tools. The outer box is a hollow box body, having a rear close end formed with a rectangular opening and a front open end through which the inner box is placed into the outer box. A lower side of the outer box is formed with a slot adjacent to the open end.

The inner box includes two lateral walls, a rear wall and a bottom board. The rear wall is formed with a notch in which a resilient latch block is located. When the inner box is fitted into the outer box, the resilient latch block is latched in the rectangular opening so as to secure the inner box in the outer box. Reversely, when the inner box is drawn out of the outer box, the resilient latch block is latched in the slot to prevent the inner box from slipping out of the outer box. The bottom board is formed with several slits at front end to divide the front end of the bottom board into several resilient plates. Two symmetrical recesses are formed on front ends of the two lateral walls. The transverse pin is horizontally fixed in the recesses. Each tool is formed with a through hole at rear end for the transverse pin to pass therethrough. An upper side of the outer box is disposed with a clip member for hanging the tool kit on a belt or a pocket. A first or a second lateral side of the outer box is disposed with a hanging lug for hanging the tool kit.

The features of the present invention are as follows:

1. The inner box is drawably received in the outer box and secured therein by the engagement between a resilient latch block and a rectangular opening.

2. The tools are received in the inner box and hidden in the outer box along with the inner box. Moreover, the resilient plates of the front end of the inner box permit the tool to be rotated through 180 degrees.

3. A couple effect occurs between the transverse pin and the tool at the center of the transverse pin, while a torque effect occurs between the transverse pin and the tool at the lateral end thereof.

4. An upper side of the outer box is disposed with a clip member for hanging the tool kit on a belt or a pocket.

5. A first or a second lateral side of the outer box is disposed with a hanging lug for hanging the tool kit.

The advantages of the present invention are as follows:

1. By means of the physical torque principle with respect to the transverse pin (arm of application force), the application force can be converted into several times action force so as to save the strength.

2. By means of the physical couple principle of the tool and the transverse pin, the application force is saved.

3. With the transverse pin serving as a rotary shaft, the tool can be rotated through 180 degrees out of the inner box for use or into the inner box for storage.

4. The sharp tools are hidden in the inner and outer boxes to avoid accident.

5. The volume of the tool kit is small so that the space is saved.

6. The small flashlight provides illumination for the use of the tools at night.

7. The transverse pin passes through the tools to serially connect the tools and the inner box as an integrated unit so that the tools will not scatter and drop down.

The present invention can be best understood through the following description and accompanying drawing, wherein:

DETAILED DESCRIPTION OF THE PREFERRED EMBODIMENTS

Figure 1:
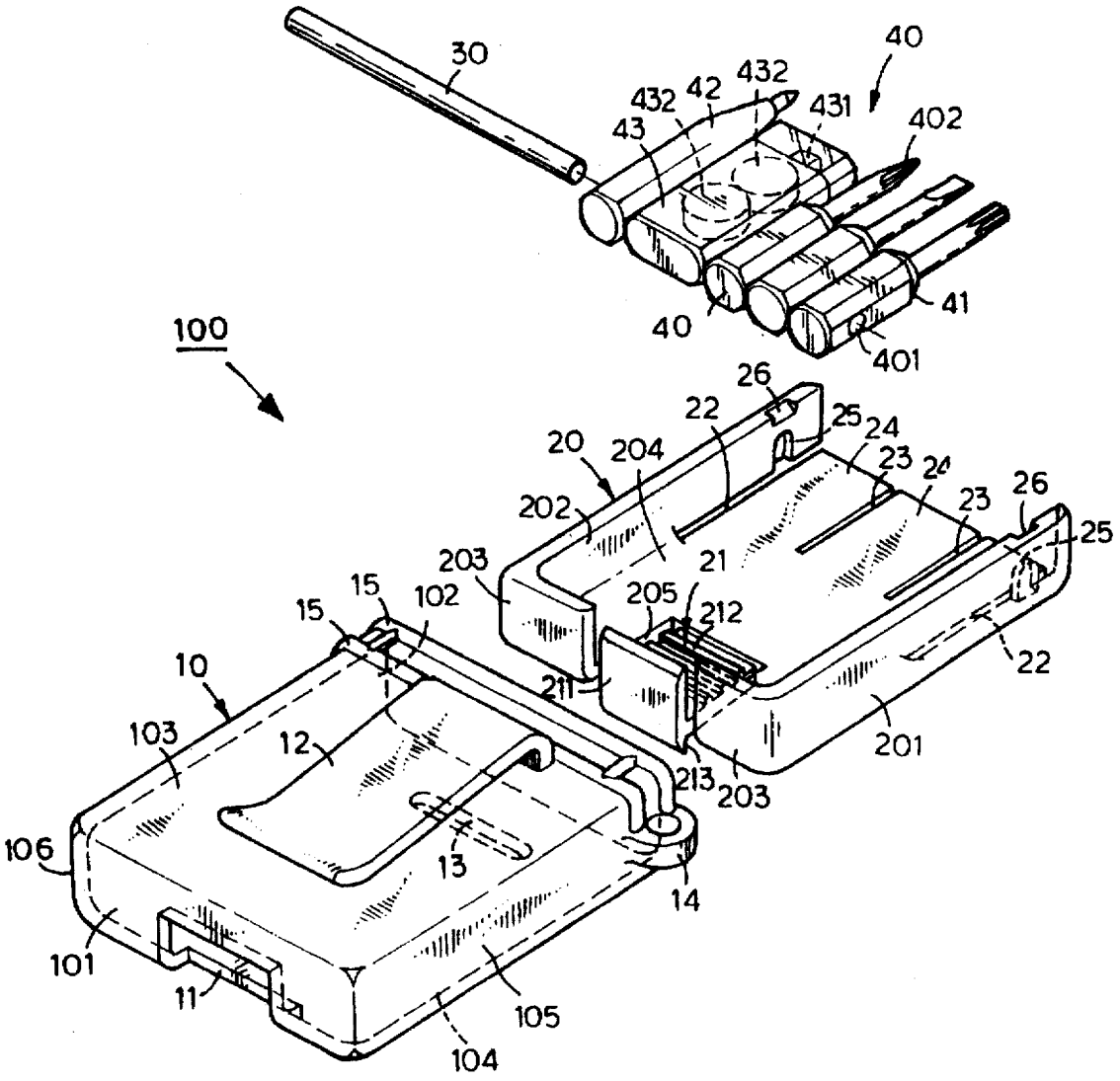
FIG. 1 is a perspective exploded view of the tool kit of the present invention.

Please refer to FIG. 1. The tool kit 100 of the present invention includes an outer box 10, an inner box 20, a transverse pin 30 and several tools 40. The outer box 10 is a hollow box body having a rear close end 101 formed with a rectangular opening 11 and a front open end 102. The inner box 20 can placed into the outer box 10 through the open end 102. A clip member 12 (which can be omitted) is disposed on an upper side 103 of the outer box 10. A lower side 104 of the outer box 10 is formed with a slot 13 adjacent to the open end 102. A first or a second lateral side 105 or 106 can be disposed with a circular hanging lug 14 (which can be omitted). In this embodiment, the lug 14 is disposed near the open end 102. However, the position of the lug is not limited. In addition, The periphery of the open end 102 is disposed with slipproof stripes 15 (which can be omitted).

The inner box 20 includes two lateral walls 201, 202, a rear wall 203 and a bottom board 204. The rear wall 203 is formed with a notch 205 in which a slightly downward inclined resilient latch block 21 is located. The latch block 21 includes a vertical plate 211 and a horizontal plate 212 which are integrally connected with the inner box 20. The vertical plate 211 and the rear wall 203 together achieve a shading and stopping effect. A latch hook 213 downward extends from the lower edge of the vertical plate 211 and protrudes under the horizontal plate 212. The bottom board 204 is formed with several slits in which two longer slits 22 are disposed on the corners of the lateral walls 201 and two shorter slits 23 are disposed on the front section of the bottom board at equal intervals so as to form three resilient plates 24. The number of the resilient plates is determined as necessary. Two symmetrical recesses 25 are formed on the front ends of the two lateral walls 201, 202. The metal transverse pin 30 is horizontally fixed in the recesses 25. The transverse pin 30 is passed through several tools 40 which can be screwdriver 41, ball pen 42, small flashlight 43, wrench or drill. Each tool 40 is formed with a through hole 401 at the end for the transverse pin 30 to pass therethrough, serving as a rotary shaft. In addition, a slope dent 26 is disposed above each recess 25, whereby the transverse pin 30 can be easily guided into the recess 25 and fixed therein.

Figure 2:
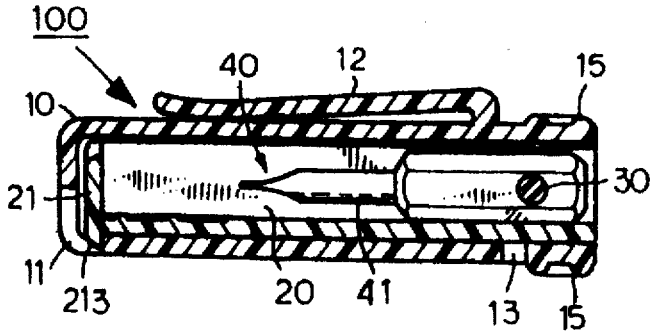
FIG. 2 is a sectional view of the tool kit, showing the operation thereof in a first state.

FIG. 2 is a sectional view of the tool kit 100 in which the inner box 20 is hidden and fixed in the outer box 10 with the latch hook 213 of the resilient latch block 21 latched in the rectangular opening 11 of the outer box 10. The tools 40 are hidden in the inner box 20 with the front ends 402 directed to the rear wall of the inner box 20 and the rear ends 403 directed to the open end of the inner box 20.

Figure 3:
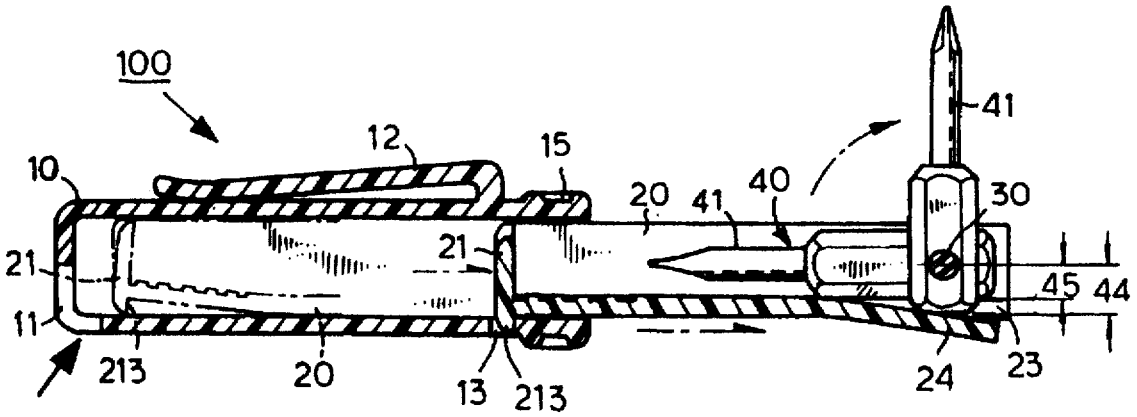
FIG. 3 is a sectional view of the tool kit, showing the operation thereof in a second state.

Referring to FIG. 3, when the latch hook 213 of the inner box 20 is lifted and pushed by a user's finger in a direction of the arrow, the latch hook 213 is disengaged from the rectangular opening 11. At this time, the user can push the inner box 20 forward out of the outer box 10 until the latch hook 213 is latched in the slot 13 and stopped from further moving forward.

At this time, the tools 40 are totally exposed outside the outer box 10 for the user to choose the needed tools. For example, the screwdriver 41 can be rotated about the transverse pin 30 through 180 degrees to make the front end thereof directed to outer side. It should be noted that the length 44 from the center of the transverse pin to the rear end of the screwdriver is larger than the length 45 from the center of the transverse pin to the bottom board of the inner box so that when rotated, the rear end 411 of the screwdriver 41 will force the resilient plate 24 of the inner box to incline downward. In the case that the screwdriver 41 is in an upright state, the resilient plate 24 is inclined by a greatest inclination. However, when the screwdriver 41 is moved to the horizontal position, the resilient plate 24 will be restored to its home position.

Figure 4:
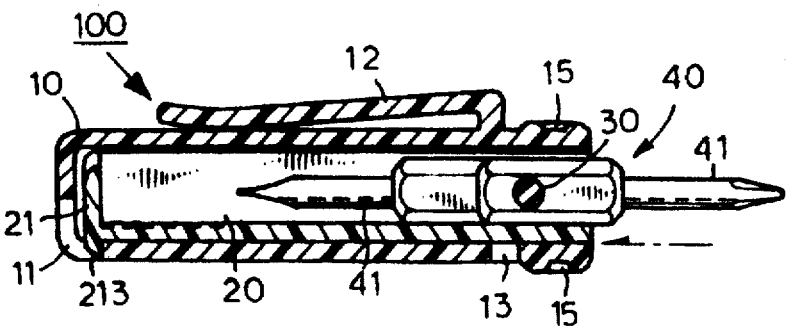
FIG. 4 is a sectional view of the tool kit, showing the operation thereof in a third state.

Referring to FIG. 4, the inner box 20 can be then again retracted into the outer box 10 with the front end of the screwdriver 41 exposed outside and the rear end hidden in the inner box 20. At this time, the tool kit 100 can serve as a screwdriver.

When it is desired to retrieve the screwdriver 41 into the inner box 20, the above steps are reversely performed and the inner box 20 is again hidden in the outer box 10.

Figure 5:
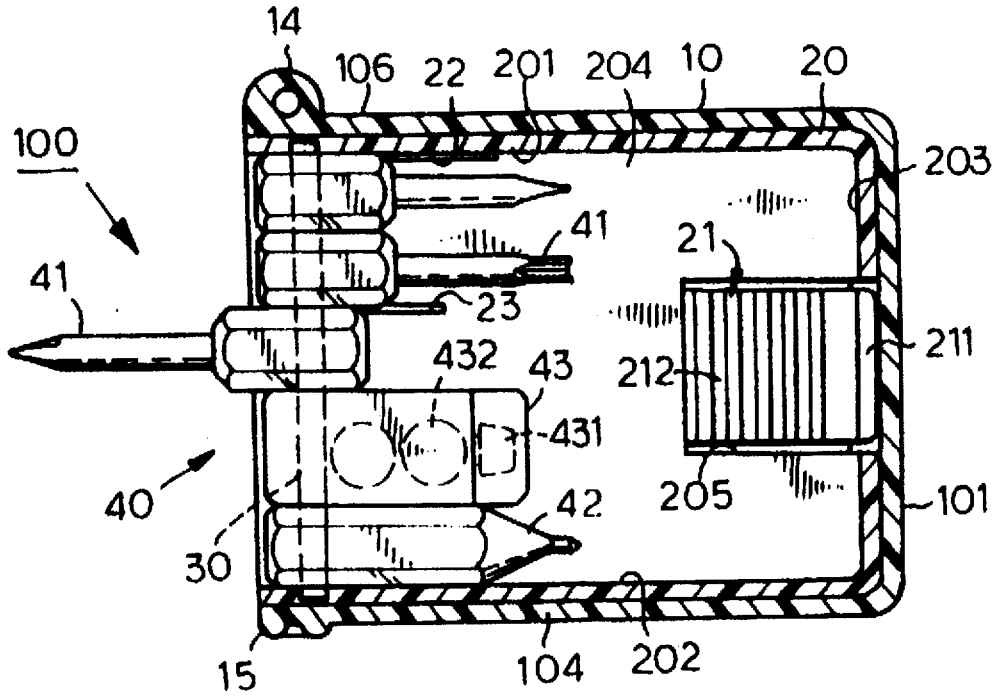
FIG. 5 is a top sectional view of the tool kit.

FIG. 5 is a top sectional view of the tool kit, wherein two physical effects occur between the screwdriver 41 and the transverse pin 30. The first is a torque effect, that is, according to the principle that torque=arm of force*applied force, the applied force can be converted into several times action force. With respect to the tools at two ends of the transverse pin, the arm of force is the transverse pin 30 so that the longer the arm of force is, the less the application. force is. The second effect is the couple principle, that is, according to the principle that couple strength=one of two forces * arm of couple, the force applied to the tool at the center of the transverse pin can be saved. (The two forces mean the force applied to two ends of outer box when held by three fingers.)

Figure 6:
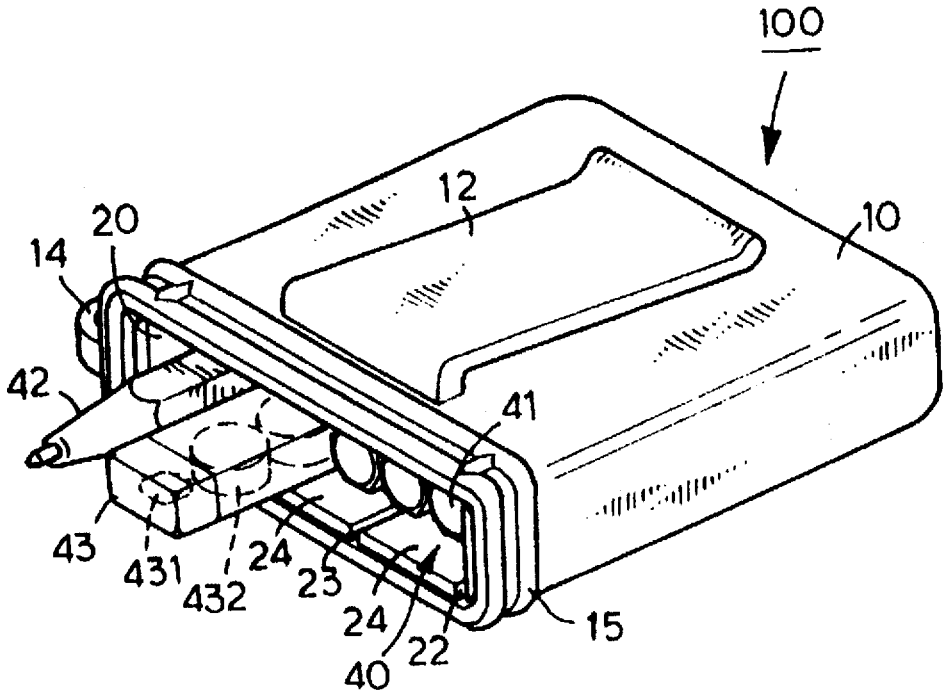
FIG. 6 is a perspective assembled view of the tool kit of the present invention.

Referring to FIG. 6, the inner box 20 is hidden in the outer box 10 and the tools 40 are partially hidden in the inner box 20. However, a ball pen 42 and a small flashlight 43 are exposed outside the inner and outer boxes 20, 10. The flashlight 43 has a light emitting diode 431 at front end and two internal lithium cells 432 so as to provide illumination for various types and specifications of tools at night.

In addition, the clip member 12 of the outer box 10 enables the tool kit 100 to be hung on a belt or a pocket. Also, by means of the lugs 14 of the outer box 10, the kit tool 100 can be hung on a key chain as an accessory or hung on other articles.

Figure 7:
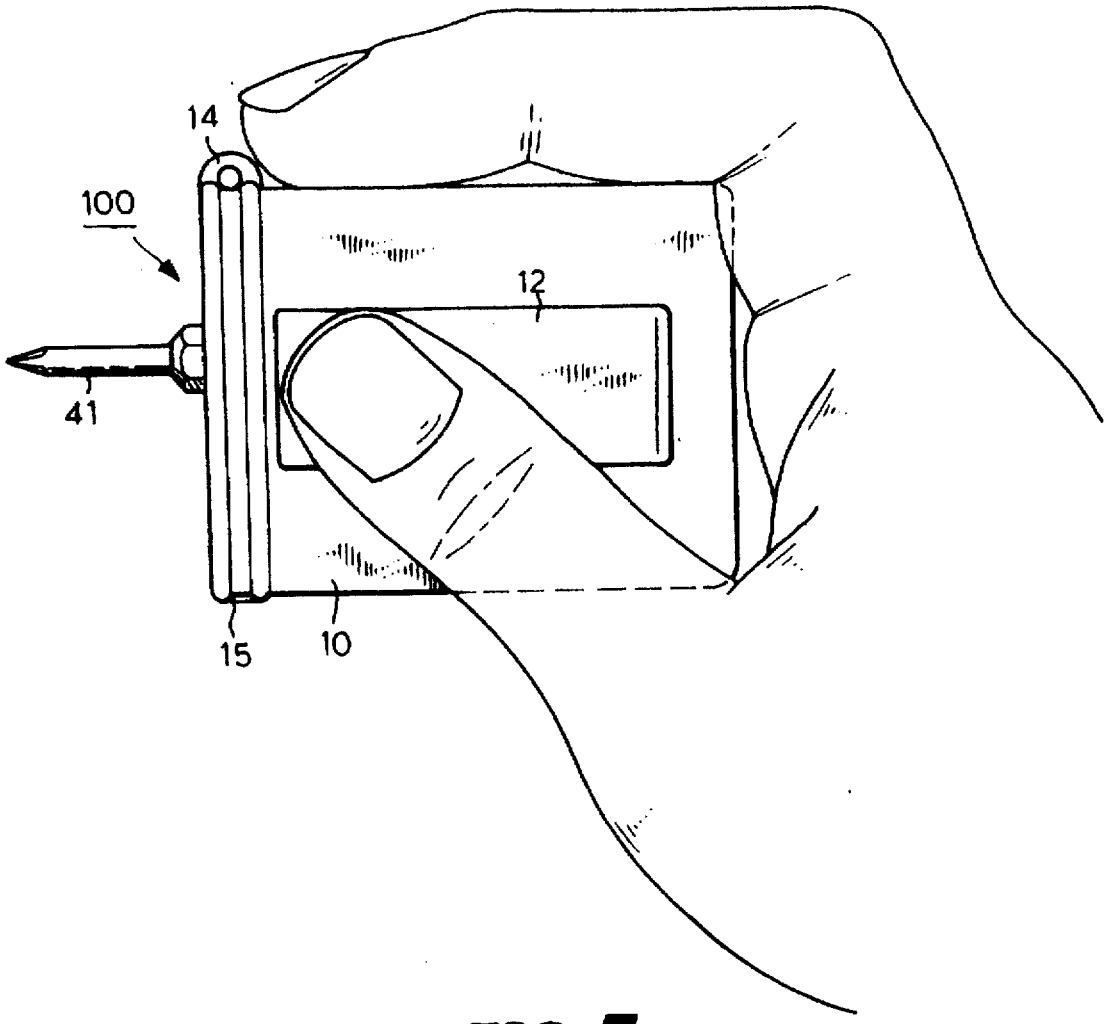
FIG. 7 shows the application of the tool kit of the present invention.

FIG. 7 shows the application of the tool kit, wherein the tool kit 100 is held in the user's hand. The user can hold the outer box 10 with three fingers to use the tool such as the screwdriver 41. The slipproof stripes 15 of the outer box 10 achieves a slipproof effect so as to prevent the tool kit 100 from slipping out of the fingers.

Figure 8:
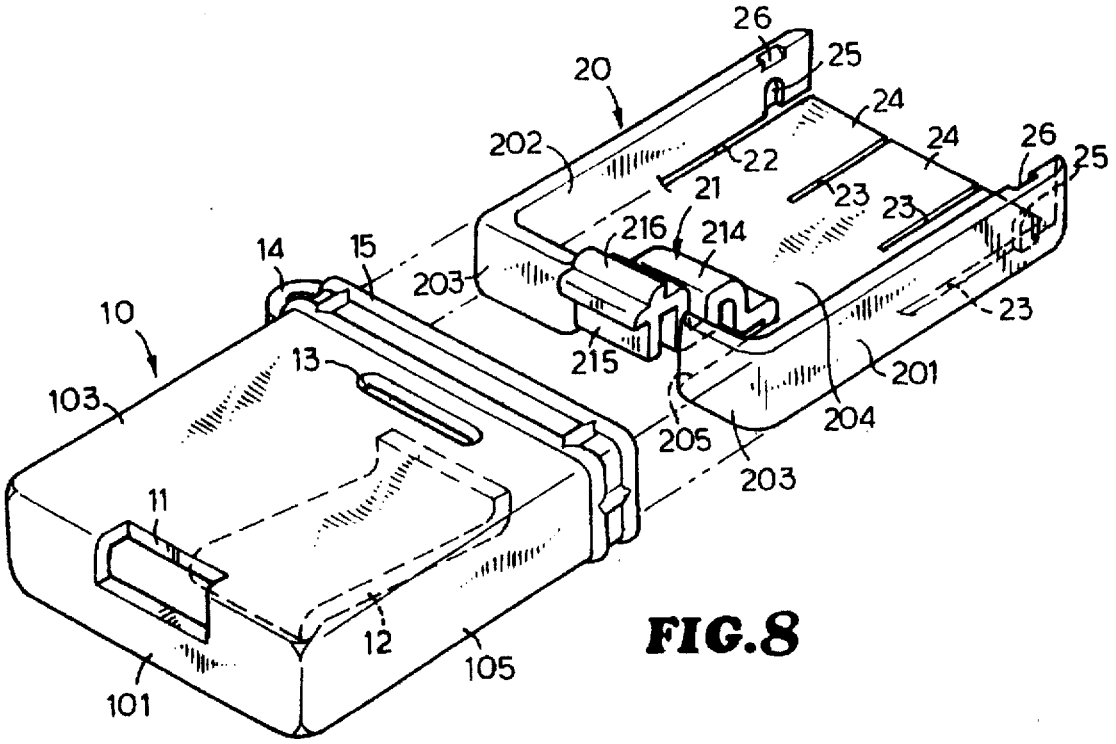
FIG. 8 is a perspective exploded view of another type of tool kit of the present invention.
Figure 9:
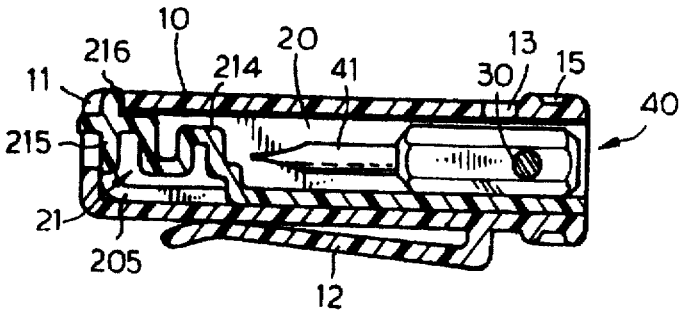
FIG. 9 is a sectional view according to FIG. 8.
Figure 10:
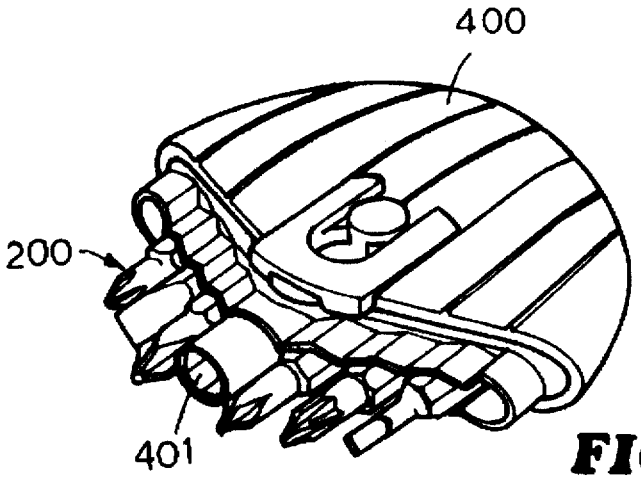
FIG.10 (PRIOR ART)
FIG. 10 is a perspective assembled view of a conventional tool kit.
Figure 11:
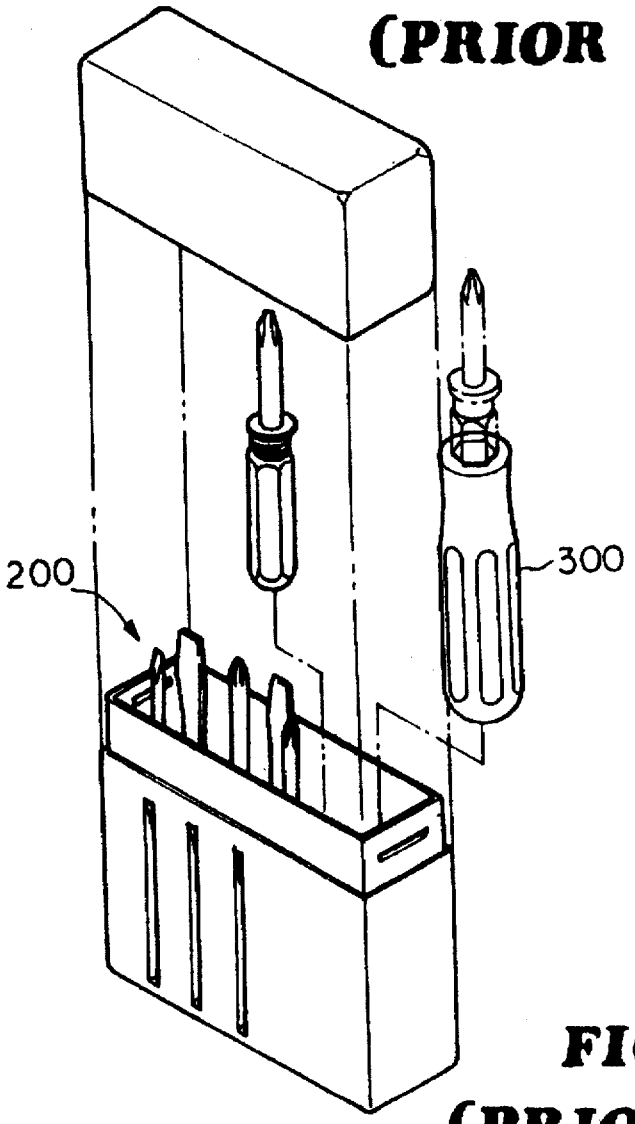
FIG.11 (PRIOR ART)
FIG. 11 is a perspective assembled view of another conventional tool kit.
Figure 12:
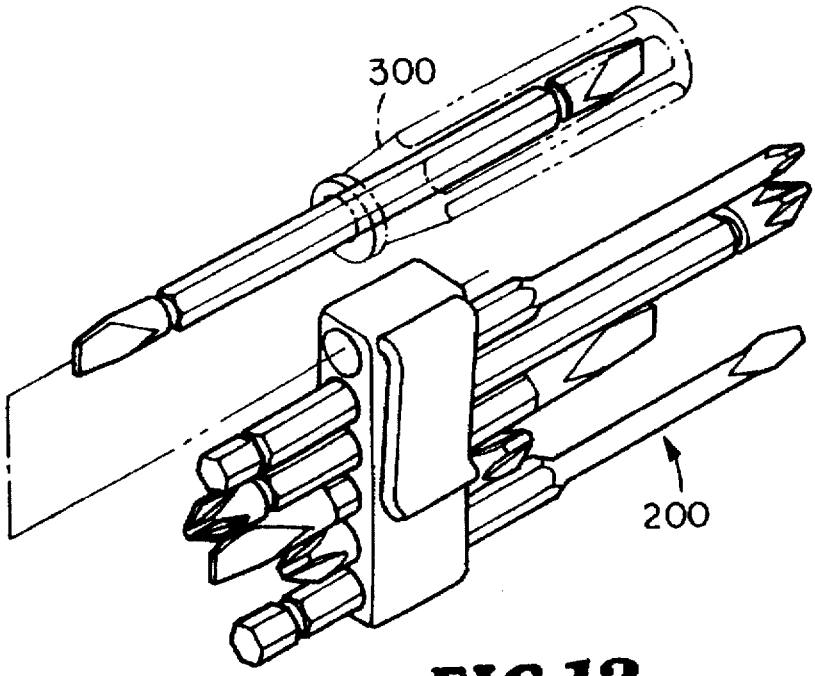
FIG.12 (PRIOR ART)
FIG. 12 is a perspective assembled view of still another conventional tool kit.
Figure 13:
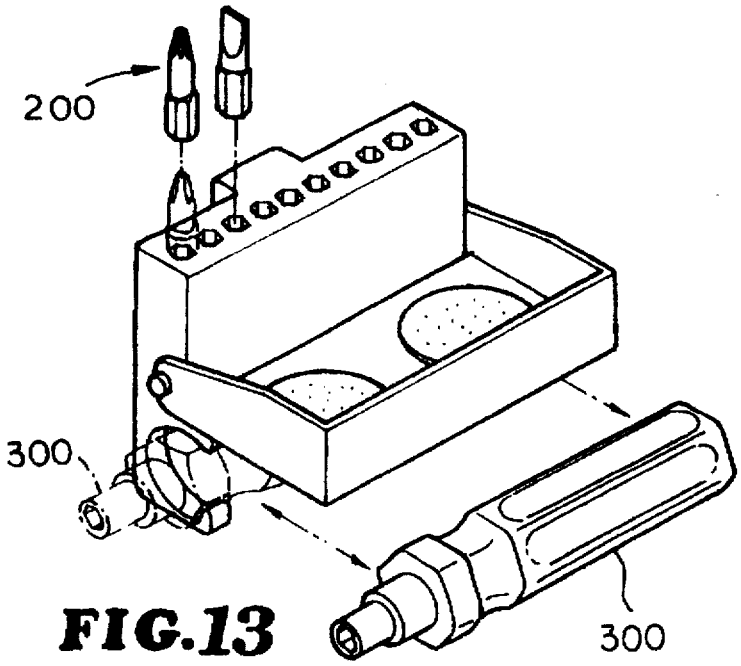
FIG.13 (PRIOR ART)
FIG. 13 is a perspective assembled view of still another conventional tool kit.

FIG. 8 shows another type of tool kit of the present invention in which the resilient latch block 21 of the inner box 20 includes a bow-like horizontal plate 214 and a vertical plate 215 integrally connected with the horizontal plate 214. The upper end of the vertical plate is disposed with a latch hook 216 which can be latched in a rear rectangular opening 11 of the outer box 10 so as to secure the inner box in the outer box as shown in FIG. 9. It should be noted that the shape of the resilient latch block 21 Is not limited. The resilient latch block 21 only needs to include a well resilient horizontal plate and a vertical plate with a latch hook structure for achieving an excellent latching effect.

It is to be understood that the above description and drawings are only used for illustrating some embodiments of the present invention, not intended to limit the scope thereof. Any variation and derivation from the above description and drawings should be included in the scope of the present invention.

What is claimed is:

1. A portable hanging type tool kit structure comprising an outer box, an inner box, a transverse pin and several tools, wherein the outer box is a hollow box body for receiving the inner box, while the tools are received in the inner box, said tool kit structure being characterized in that:

the outer box has a rear closed end formed with a rectangular opening and a front open end, a lower side of the outer box being formed with a slot adjacent to the open end;

the inner box includes two lateral walls, a rear wall and a bottom board, the rear wall being formed with a notch in which a resilient latch block is located, the latch block including a vertical plate and a horizontal plate, a front end of the horizontal plate being connected with an edge of the notch of the inner box, a latch hook downwardly extending from a lower edge of the vertical plate, the bottom board being formed with several slits at front end to divide the front end of the bottom board into several resilient plates, two symmetrical recesses being formed on front ends of the two lateral walls, the transverse pin being horizontally fixed in the recesses, a slope dent being disposed above each recess, whereby the transverse pin can be easily guided into the recess;

each tool is formed with a through hole at rear end for the transverse pin to pass therethrough, serving as a rotary shaft; and a clip member is disposed on an upper side of the outer box and a first or a second lateral side of the outer box is disposed with a hanging lug, a periphery of the open end being disposed with slipproof stripes for achieving slipproof effect.

2. A portable hanging type tool kit structure as claimed in claim 1, wherein the resilient latch block of the inner box includes a bow-like horizontal plate and a vertical plate integrally connected with the horizontal plate, an upper end of the vertical plate being disposed with a latch hook.

* * * * *